United States Patent [19]

Poullot

[11] 4,145,881

[45] Mar. 27, 1979

[54] DEVICE FOR CONTROLLING THE COMPOSITION OF THE EXHAUST GASES FROM A HEAT ENGINE

[75] Inventor: Bernard Poullot, Rueil-Malmaison, France

[73] Assignees: Automobiles Peugeot, Paris; Regie Nationale des Usines Renault, Boulogne-Billancourt, both of France

[21] Appl. No.: 859,208

[22] Filed: Dec. 9, 1977

[30] Foreign Application Priority Data

Dec. 30, 1976 [FR] France ..... 76 39638

[51] Int. Cl.[2] ..... F02M 31/00; F02D 5/02; F01N 3/15

[52] U.S. Cl. ..... 60/276; 123/119 EC; 123/122 AB; 123/122 AC

[58] Field of Search .... 123/119 EC, 32 EA, 122 AB, 123/122 AC; 60/276, 285

[56] References Cited

U.S. PATENT DOCUMENTS

| | | | |
|---|---|---|---|
| 3,910,240 | 10/1975 | Omoni et al. | 60/276 |
| 4,023,357 | 5/1977 | Masaki | 123/119 EC |
| 4,062,334 | 12/1977 | Toda et al. | 123/122 AB |

*Primary Examiner*—Ronald H. Lazarus

*Attorney, Agent, or Firm*—Burns, Doane, Swecker & Mathis

[57] ABSTRACT

The invention improves the regulation of the composition of the exhaust gases in the case of engines having a plurality of rows of cylinders each of which rows is associated with an exhaust pipe. For this purpose, small-section pipes respectively lead from the exhaust pipes and have a common junction at which the analyzing probe is located. This junction is connected to the exhaust manifold preferably by way of a pipe which serves also to heat the induction pipe of the engine.

3 Claims, 1 Drawing Figure

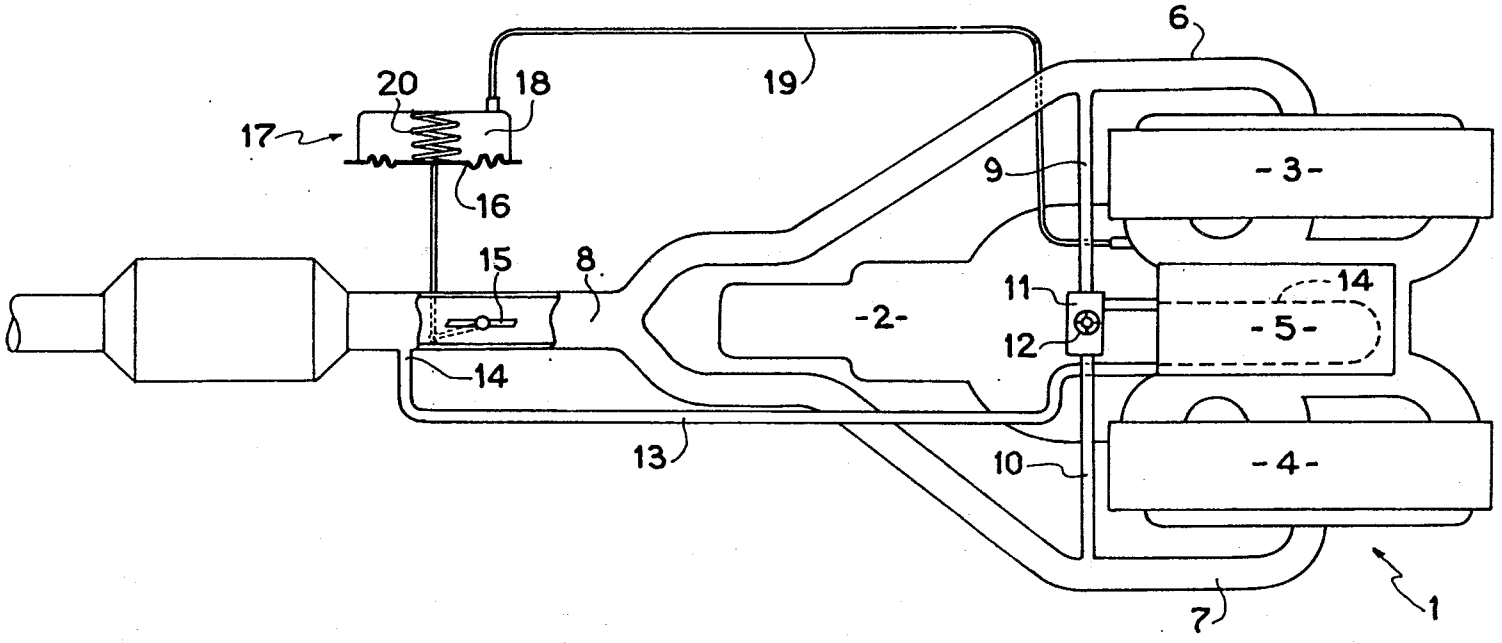
1
-3-
-4-
-5-
-2-
14
6
7
9
11
12
10
19
13
8
18
16
15
14
20
17

DEVICE FOR CONTROLLING THE COMPOSITION OF THE EXHAUST GASES FROM A HEAT ENGINE

The invention relates to an improvement in means for controlling the composition of the exhaust gases from a heat engine for the purpose of applying them to engines in which the cylinders are arranged in a plurality of rows and in particular in V-engines.

In particular, probes or detectors are known which are capable of measuring the content of oxygen in the exhaust gases. A probe which permits obtaining this result is sold by the Company ROBERT BOSCH under the name "λ probe". Such probes are normally provided for regulating the metering of the mixture of air and fuel supplied to the cylinders of the engine so as to conform as close as possible to the stoichiometric mixture proportions.

In order that these regulating devices operate correctly, it is necessary that any anomaly in the composition of the exhaust gases be detected as rapidly as possible and that the heating of the probe after starting up be as rapid as possible. Consequently, the probe must be placed relatively close to the engine cylinders.

Now, in engines having a plurality of rows of cylinders and in particular V-engines, each row of cylinders has its own exhaust line, the different lines being interconnected adjacent to the rear of the vehicle in a common manifold. Unfortunately, the exhaust lines can only be connected rather far away from the engine owing to the presence of the transmission mechanism. Consequently, one is faced with the following alternative for the positioning of the probe:

either the probe must be placed in the common manifold and the response time of the probe is excessively long;

or it must be placed in one of the exhaust lines leading from one row of cylinders, but in this case the quality of the regulation depends on the quality of the distribution of the mixture between the rows of cylinders.

An object of the invention is to overcome the aforementioned drawbacks and to provide a particularly simple arrangement whereby the probe is placed sufficiently close to the engine and yet is influenced by all the gases coming from different rows of cylinders.

According to the invention, there is provided a heat engine having a plurality of rows of cylinders each one of which rows has an exhaust pipe, the exhaust pipes being connected to a common exhaust manifold and an analyzing probe being disposed in the path of the exhaust gases, wherein small-section pipes respectively extend from the exhaust pipes and are interconnected at a common junction at which the analyzing probe is placed, said junction being connected to the exhaust manifold by a third pipe.

Preferably, the connection of said junction to the exhaust manifold by the third pipe is at a point located downstream of a butterfly throttle valve which is arranged to be completely closed or partially closed when the engine is operating at idling speed and more open when the engine is running at full load.

According to an improvement of the invention, the third pipe which connects the junction to the exhaust manifold is employed for heating the induction pipe of the engine.

The ensuing description is of an example of application to an engine having cylinders arranged in the form of a V shown diagrammatically in plan view in the accompanying single FIGURE.

This FIGURE shows an engine 1 of an automobile vehicle associated with a transmission mechanism 2. This engine comprises two rows 3, 4 of cylinders disposed in the form of a V and supplied with fuel and air by way of an induction pipe 5. The exhaust gases from the rows of cylinders are discharged by way of two pipes 6, 7 constituted by pipes of relatively large section. These two pipes are interconnected at the rear of the transmission mechanism 2 in a common manifold 8.

Two small-section pipes 9, 10 extend from regions of the exhaust pipes 6, 7 close to the rows of cylinders and are united at a junction 11 in which the analyzing probe 12 is mounted. The probe is of known type and will therefore not be described in detail.

Extending from the junction 11 is a third small-section pipe 13 which, after having formed a loop 14 adapted to heat the induction pipe 5, is connected to the exhaust manifold 8 at a point located downstream of a butterfly throttle valve 15.

The latter is connected to a diaphragm 16 of a suction vessel 17 the chamber 18 of which communicates with the induction pipe 5 by way of a pipe 19. A spring 20 biases the diaphragm 16 so that, in the absence of a suction in the induction pipe, the throttle valve 15 opens the manifold 8. Inversely, a suction in the induction pipe tends to close the throttle valve 15.

The device just described operates in a very simple manner. At idling speed and at low loads, the butterfly throttle valve 15 is closed and practically the whole of the exhaust gases circulates through the pipes 9, 10 and 13. Consequently, the gases from all the cylinders pass over the probe 12 which, owing to the small sectional size and small overall size of the pipes 9, 10 and 13, may be placed at a short distance from the engine. In this way, there is obtained a very short response time for the system regulating the metering of the carburetted mixture and a rapid heating of the probe after starting up the engine.

At full load, the butterfly throttle valve 15 opens and only a small part of the exhaust gases passes through the pipes 9, 10 and 13. In this way, it is ensured that the analyzing probe 12 and the induction pipe 5 do not reach an excessively high temperature.

Having now described my invention what I claim as new and desire to secure by Letters Patent is:

1. A heat engine having a plurality of rows of cylinders, exhaust pipes respectively combined with said rows of cylinders, a common exhaust manifold interconnecting the exhaust pipes, small-section pipes respectively extending from the exhaust pipes and interconnected at a common junction, an exhaust gas analyzing probe disposed inside said junction for exposition to exhaust gases, and a third pipe connecting said junction to the exhaust manifold.

2. A heat engine as claimed in claim 1, wherein a butterfly throttle valve which is capable of being at least partially closed when the engine operates at idling speed and open when the load on the engine increases, is disposed in the exhaust manifold and the third pipe is connected to the exhaust manifold downstream of the throttle valve relative to the direction of flow of the exhaust gases through the exhaust manifold.

3. A heat engine as claimed in claim 1, wherein the engine has an induction pipe and said third pipe is associated with the induction pipe for heating the induction pipe.

* * * * *